252-105. AU 165 EX
2-24-76 OR 3,940,341

United States Patent [19]

Gray et al.

[11] 3,940,341

[45] Feb. 24, 1976

[54] GRANULAR DETERGENT COMPOSITIONS

[75] Inventors: Frederick William Gray, Summit; Virgil John Richter, West Orange; Andrew Henry Limekiller, Belle Meade, all of N.J.

[73] Assignee: Colgate-Palmolive Company, New York, N.Y.

[22] Filed: Mar. 22, 1973

[21] Appl. No.: 343,986

[52] U.S. Cl. ..... 252/105; 252/133; 252/531; 252/534; 252/536; 252/539; 252/540

[51] Int. Cl.[2] ..... C11D 7/54

[58] Field of Search ..... 252/105, 534

[56] References Cited

UNITED STATES PATENTS 3,741,901 6/1973 Ziffer ..... 252/105 X

*Primary Examiner*—Benjamin R. Padgett
*Assistant Examiner*—E. Suzanne Parr
*Attorney, Agent, or Firm*—Herbert S. Sylvester; Murray M. Grill; John J. Tomaszewski

[57] ABSTRACT

Spray dried granular compositions containing sodium sulfite.

12 Claims, No Drawings

GRANULAR DETERGENT COMPOSITIONS

This invention relates to spray drying of detergent compositions.

It has been found that the inclusion of sodium sulfite in built detergent compositions is highly beneficial in improving stain removal. Sodium sulfite is, however, a relatively unstable material in that it becomes oxidized in air to form sodium sulfate, particularly when the sulfite is in hydrated condition.

It has now been discovered, surprisingly, that compositions containing significant proportions of sodium sulfite may be spray dried from a hot aqueous suspension thereof to form granular compositions under hot wet oxidizing conditions, and that the resulting product (which is in the form of hollow air-containing beads of relatively low density) contains, in unoxidized condition, at least about 80%, such as over 90%, e.g. about 90–100%, of the sodium sulfite originally added to the aqueous suspension, and also substantially retains its sodium sulfite content on storage under heated conditions.

In a preferred embodiment of the invention the sodium sulfite content of the spray-dried beads is above about 3% and below about 70%, more preferably within the range of about 5 to 50%, preferably about 10 to 40% such as 15, 20 or 25%. A particularly preferred type of composition contains (*a*) organic detergent (*b*) an alkali metal builder salt and (*c*) sodium sulfite in which the ratio of $a + b$ to $c$ is in the range of about 1:5 to 5:1, preferably at least about 1:1, e.g., about 1.5:1 to 5:1 such as about 2:1, about 3:1 or about 4.5:1. In preferred compositions, the ratio of *b:a* is in the range of about 0.5:1 to 4:1 (more preferably about 0.7:1 to 2.5:1), the ratio of *b:c* is in the range of about 0.8:1 to 3.5:1 (more preferably about 1:1 to 2.5:;1), and the ratio of *a:c* is in the range of about 0.3:1 to 2:1 (more preferably about 0.5:1 to 1.6:1).

The proportion of organic detergent is preferably in the range of about 5 or 10 to 30 or even 40% and the proportion of alkali metal builder salt is preferably in the range of about 10 or 15 or 20 to 40 or 50%. Other conventional ingredients may also be present, such as diluents like sodium sulfate, brighteners and (particularly in washing, rather than soaking products) antiredeposition agents such as those of the water-soluble polymeric type, e.g. sodium carboxymethylcellulose or polyvinyl alcohol. The organic detergent is preferably an anionic surface active agent which is a sulfate or sulfonate salt (e.g. an alkylbenzenesulfonate, olefin sulfonate, paraffin sulfonate, alkyl ether sulfate, or alkyl sulfate) or nonionic detergent or mixture thereof.

In the process of this invention conventional steps of crutching and spray drying may be employed. Thus, the spray drying may be effected by forcing an aqueous slurry of the ingredients through a spray nozzle at the top of a spray tower into which heated evaporative gas such as air or flue gas is introduced. The gas may be introduced at the top of the tower to flow co-current with the sprayed material or into the lower part of the tower to flow counter-current. The composition is preferably dried to a total moisture content of about 1 or 2 to 15%. The moisture content can be determined readily by a conventional Cenco Moisture Tester (in which a predetermined weight of the dried composition on a balance pan is exposed to the heat of a hot electric lamp, situated at a predetermined distance from the sample, until the weight of the sample becomes constant, at which time the weight loss, due to evaporation of moisture, including water of hydration, is measured) or by conventional xylol distillation methods. The product is in the form of small hollow spheroids which may be completely separate or may form aggregates of such spheroids clumped together as unitary vesiculated structures having generally rounded (e.g. bulbous) smooth surfaces. The spray dried detergent granules are typically of such size resulting in virtually all of the material being retained on a 200 mesh sieve, half being retained on a 60 mesh screen and all passing through a 10 mesh sieve (all sieve sizes given here are U.S. Standard Series 200, mesh having an opening of 0.074 mm; 60 mesh 0.250 mm and 10 mesh 2.0 mm openings). The bulk density of the spray dried detergent granules is usually below about 0.7 g/cc generally less than 0.6, such as about 0.3 to 0.4 or 0.5 g/cc. The particles may be treated with a suitable agent (e.g. dusted with a small amount of very finely divided silica or silicate such as colloidal silica or calcined aluminum silicate, of particle size less than 5 microns) to improve their flowability, and may be packed, if desired, in containers having walls of low moisture transmissivity.

The slurry to be sprayed may be formed in a crutcher (a mixing vessel equipped with a high speed stirrer) by adding the individual ingredients to water. Generally the sodium sulfite will be added in finely powdered form, preferably as the anhydrous variety to the detergent mixed with water; and the other ingredients added before, during or after the addition of sulfite. The water content of the slurry is preferably less than about 50%, such as in the range of about 20–45% or less, and the slurry may be at a temperature in the range of about 90°–170°F, e.g. about 130° to 160°F. The slurry is generally agitated vigorously and then passed through an attrition device such as a Fitzmill grinder to insure that it is a smooth lump-free suspension of fine particles of those ingredients that are present in excess of their solubility, in a solution of the others. It is then stored, while hot, in a reservoir, for spraying; in commercial operations a large reservoir suitable for receiving several batches of crutched slurry is employed and the average residence time of the hot slurry after the addition of the solid ingredients and before leaving the spray nozzle may be well over 15 minutes, such as a half hour or even several hours. The slurry generally contains air dispersed therein through the action of the agitating and/or grinding devices; for instance it is usually stirred vigorously with a propeller-type stirrer which forms vortices at the upper surface (slurry-air interface) of the slurry. In conventional procedures no deaeration steps are employed to remove the air; in addition the air-containing slurry is conventionally placed under high pressure (such as pressures over 100 psig, usually over 300 psig, e.g. about 400 to 1000 psig or more) by means of conventional pumps such as positive displacement pumps which drive the slurry through the feed lines under pressure to the spray nozzle, thus increasing the effective partial pressure of the air in the slurry. The temperature of the heated evaporative gas introduced into the tower is usually within the range of 300° to 900°F; it may be relatively low (e.g. in the range of 350°–450°F.) but higher temperatures (e.g. about 550°F and up to about 600°–700°F., for example) may be employed if desired. Even with counter-current spraying the temperature of the gas brought into contact with the sprayed droplets is relatively high; thus in counter-current spraying the moist gas leaving from the top of the tower is usually at least about 150°F such as about 170°, 180° to 205°F. The temperature of the evaporative gas is preferably not so high as to cause charring of the product under the spray drying conditions. The temperature of the powder leaving the bottom of the spray tower may be relatively low, e.g. about 100°F, or it may be higher (e.g. 140°, 160° or 200°F.) particularly when the incoming evaporative gas is at a high temperature.

Compositions used in the practice of this invention are preferably distinctly alkaline (owing to the presence of the alkaline builder salt), such that the pH shown by the spray-dried granules (at 0.1% concentration) in water is within the range of about 8 to 10, more usually between 9 and 10. (These ranges also apply to a mixture of the same ingredients in the same proportions, which has not been slurried and spray dried). Sodium silicate is preferably present in amount of at least about 3% (e.g. about 5–35%) of the total composition; the sodium silicate may have a relative high $SiO_2$ content, e.g. an $Na_2O:SiO_2$ ratio in the range of about 1:2 to 1:3 (such as about 1:2.4). In certain formulations a carbonate, such as sodium carbonate is also present. In others the builder salt is a phosphate such as pentasodium tripolyphosphate, tetrasodium pyrophosphate, etc. Other builder salts which may be present alone or in combination are organic builder salts such as citrates such as sodium citrate, sodium polycarboxylates, e.g., polymaleates of lower molecular weight (generally below 1000), salts of phosphonic acids such as $N(CH_2PO_3H_2)_3$, "Dequest 2000": $(H_2O_3PCH_2)_2N$-$CH_2CH_2N(CH_2PO_3H_2)_2$; $CH_3(CH_2)_{11}N(CH_2PO_3H_2)_2$, "Dequest 2011": $CH_3CH(PO_3H_2)$: $CH_2(OH)$ $PO_3H_2$, e.g. "Dequest 2006", imino acetates such as E.D.T.A. or trisodium nitrilotriacetate ("NTA"), disodium hydroxyethyl iminodiacetate ("HEIDA"), and sodium boroglucoheptanoate. Any other builder salts used in detergent formulations, and mixtures of the foregoing materials can also be used.

Compositions containing hydratable phosphates such as sodium tripolyphosphate usually produce spray dried granules of very good flow characteristics even at high moisture contents. Such phosphates are, however, thought to be undesirable ecologically for certain areas. It has been found that free-flowing granules of excellent detergent performance characteristics, particularly suitable for use (in admixture with proteolytic enzymes in small amounts) in the soaking of clothes to remove stains prior to machine washing with conventional detergent compositions, are obtained at greatly reduced phosphate contents by replacing part of the phosphate with sodium sulfite. Thus the composition may comprise, instead of 35% sodium tripolyphosphate, about 25%, 20%, 15%, 10% or even 5% thereof, together with amounts of sodium sulfite of say about 5 or 10 to about 50% or more, together with an organic detergent. For instance the ratio of sodium tripolyphosphate to sodium sulfite in the granules may be in the range of about 3:1 to 1:8, such as about 2:1, 1:1, 1:2, 1:3 or 1:4.

The following Examples are given to illustrate this invention further. In this application all proportions are by weight unless otherwise indicated. In the Examples all pressures are substantially atmospheric unless otherwise indicated.

EXAMPLE 1

The following ingredients are mixed with water in a crutcher to form a hot aqueous suspension and then sprayed into hot air in a spray tower to form hollow granules: 9.9 parts sodium linear tridecylbenzenesulfonate, 23.5 parts pentasodium tripolyphosphate, 7.0 parts sodium silicate ($Na_2O:SiO_2$ ratio about 1:2.35) 2.0 parts of nonionic detergent (Neodol 45–11 which is a primary alkanol of an average of 14 to 15 carbon atoms ethoxylated with an average of 11 mols of ethylene oxide per mol of alkanol), 0.3 part of brightener, 0.01 part of Iphol 033, a phenolic antioxidant conventionally employed in the same amount in spray-drying to protect the organic detergent from decomposition on storage, 33.4 parts of sodium sulfate, 10.0 parts of sodium sulfite (a total of 86.11 parts). The resulting sprayed beads containing about 10 parts of residual moisture (making a total of 96.11 parts) are then mixed with 0.175 part of perfume, 0.70 part of proteolytic enzyme concentrate (Novo Alcalase having an activity of about 1.5 Anson units per gram) and 3.015 parts of the nonionic detergent Neodol 25–7. Chemical analysis shows that the final product still contains about 10% sodium sulfite. It retains substantially the same sodium sulfite content on aging at 120°F for over 14 days in closed moisture barrier cartons as well as in such cartons open to the atmosphere. The product has good flow characteristics.

In formulating the crutcher mix the ingredients are added in the following order to the water at about 150°F: anionic detergent, sodium silicate, (as a liquid aqueous solution), brightener, sodium sulfate, sodium sulfite, phosphate, and nonionic detergent. The sodium sulfate, sodium sulfite and phosphate are all added as anhydrous powders. The resulting air-containing slurry, having an apparent density of 1.34, is ground, reheated to about 150°F, pumped at a pressure of 650 psig to a nozzle, and sprayed therefrom into the top of a spray tower, while hot air at 350°F is supplied to the bottom of the tower (the air moving upward through the tower countercurrent to the downward movement of the sprayed droplets and leaving from the top at an air temperature of 170°F).

In the foregoing example 1 the brightener is 4,4'-bis(4-anilino-6-morpholino-s-triazine-2-ylamino)-2,2'-stilbene disulfonic acid disodium salt and the phenolic antioxidant (Iphol 033) is 2,6-di-tert-butylphenol.

EXAMPLE 2

Example 1 is repeated except that the proportion of sodium sulfate is 28.4 instead of 33.4 and the proportion of sodium sulfite is 15.0 instead of 10.0. The slurry temperature is 160°F, the spraying pressure is 750 psig, the apparent density of the slurry is 1.44 g/cc and the air inlet and outlet temperatures are 520° and 190°F, respectively.

EXAMPLE 3

Example 1 is repeated except that the proportion of sodium tripolyphosphate is 13.5 parts and the proportion of sodium sulfite is 20 parts.

EXAMPLE 4

Example 1 is repeated, twice, each time using no phosphate and (in one case) using added soda ash in the crutcher mix, the proportions in the sprayed beads being as follows: (*a*) 10 parts of sodium linear tridecylbenzenesulfonate, 8.0 parts of the sodium silicate, 0.3 part of the brightener, 0.01 part of the phenolic stabilizer, 2.0 parts of the Neodol 45–11, 52.76 parts sodium sulfate, 15.0 parts sodium sulfite, 2.5 parts moisture (total 90.57 parts); (*b*) the same as *a*, above, except that 8 parts of soda ash are also present and the amount of sodium sulfate is 44.26 parts (total 90.07 parts). In both cases the resulting sprayed beads are mixed with 3.015 parts of the nonionic detergent Neodol 25–7, 4.5 parts (or 5 parts for the *b* beads) of citric acid, 0.74 parts of the enzyme concentrate of Example 5, 0.175 part of perfume and 1 part of powdered flow control agent (calcined aluminum silicate). In each case the slurry temperature is 130°F. For *a* the spraying pressure is 450 psig, the apparent density is 1.29 g/cc the air inlet temperature is 450°F and the air outlet temperature is 155°F; for *b* the corresponding figures are 400 psig, 1.40 g/cc., 520°F and 190°F.

Neodol 25–7 is an ethoxylation product of 7 mols of ethylene oxide and one mol of an alkanol of 12 to 15 carbon atoms.

EXAMPLE 5

The following ingredients are mixed with water in a crutcher to form a hot aqueous suspension and then sprayed into hot air in a spray tower to form hollow granules containing about 1.2% moisture: 3 parts of sodium olefin sulfonate (produced by sulfonating an alpha olefin of 15 to 20 carbon atoms in conventional manner with about 1 mol of highly diluted $SO_3$, neutralizing with excess aqueous sodium hydroxide, and heating the alkaline mixture at a temperature above 300°F [e.g. 330°F] to ring-open sultones in said mixture), 12.3 parts of pentasodium tripolyphosphate, 39.5 parts of sodium sulfate, 3.3 parts of sodium sulfite, 3 parts of potassium carbonate, 0.29 part of ultramarine blue and 0.11 part of brightener. In formulating the crutcher mix all the ingredients are supplied as anhydrous powders except the detergent (which is an aqueous dispersion), and the mixture containing about 42% water is maintained at 138°–146°F while it is ground, stored and pumped (at a pressure of about 780–880 psig) to the spray nozzle. The air is fed countercurrent, entering at the bottom of the spray tower at a temperature of about 540°–560°F and leaving at a temperature of about 190°–200°F. Chemical analysis shows that the final product still contains over 4% sodium sulfite.

In Examples 1 and 2 the solids (i.e. non-water) content of the suspension (slurry) is 65% in Example 4 it is 60%.

Analysis for sulphite is typically carried out by conventional procedure in which a predetermined quantity of 0.1 N iodine solution is added to a predetermined weight of the sample to be tested in a flask, the mixture is allowed to stand for 5 minutes (swirling occasionally), A predetermined amount of concentrated hydrochloric acid is added, and the mixture is then titrated with 0.1 N sodium thiosulfate solution until the yellow color has almost disappeared, after which a few drops of starch indicator solution is added and the titration continued until the blue color entirely disappears.

As indicated above, the sulfite-containing spray-dried granules are preferably blended with small amounts of enzymes. These are preferably compatible proteolytic enzymes but it is within the broader scope of this invention to use amylases or lipases instead of or in admixture with the proteases or in admixture with each other. Examples of enzymes and descriptions of the form in which the enzyme is added and the amounts thereof are set forth in German DOS 2,060,095 and corresponding French Pat. No. 2,072,988 (and the corresponding U.S. application Ser. No. 98,111 filed Dec. 14, 1970) whose disclosures are incorporated herein by reference. The amount of enzyme concentration generally small in relation to the amount of sodium sulfite, e.g. such as to provide less than 0.3 Anson unit of protease and usually less than 0.2 Anson unit, such as about 0.1 or 0.05 Anson unit per gram of sodium sulfite. For conventional enzyme concentrates, the amount of such concentrate is usually well below 20%, such as less than 10% (e.g. 7% or 4% or less) of the weight of sodium sulfite.

While the invention has its greatest utility when $Na_2SO_3$ is used it is within the broader scope of the invention to replace all or part of the sodium sulfite by other readily water-soluble sulfites such as those in which both valences of the sulfite anion are joined to a metal cation whose hydroxide is a strong base, such as potassium sulfite.

The compositions of this invention generally exhibit no odor of sulfur dioxide or other noxious odor, even on storage.

The compositions of this invention may be employed for washing in cool water, e.g., at 70° to 90°F, or in warm or hot water, e.g., at 100°F., 120°F, 140°F or even hotter.

EXAMPLE 6

The product of Example 1 is compared, in a soaking test for stain removal, with a similar product containing 35% sodium tripolyphosphate and no sodium sulfite but otherwise having substantially the same composition, using 0.1% concentrations of the product in the soak water. It is found to give very good stain removal for most stains.

The soaking test is carried out by placing the stained fabrics overnight in water having a hardness of about 150 ppm and having a temperature of 105°F, into which the product has been dissolved, allowing the fabrics to soak overnight, then removing the soak water by centrifuging and washing the fabrics in a standard top loading washing machine with a commercial non-phosphate detergent. (The water used is a mixture of Piscataway, New Jersey tap water, and an appropriate amount of calcium and magnesium chlorides to raise the hardness to 150 ppm).

In each test there are employed, in quadruplicate, some 10 or 11 types of stained fabric test swatches. The tests use such stains as grass on cotton; spinach on cotton terry cloth towel; chocolate custard on cotton; grape juice on polyester-cotton permanent press fabric; blueberry pie on polyester-cotton permanent press fabric; wet clay on cotton; wet potting soil on polyester-cotton permanent press fabric; Spangler soil; EMPA No. 101 oily soil; blood-milk-ink; tea on polyester-cotton permanent press fabric.

As indicated above, the builder salt may be a salt of a carboxylic acid having a plurality of carboxylic acid groups. Other examples of such materials are the salts (e.g. of Na) of carboxymethylsuccinic acid, cyclopentanetetracarboxylic acid, mono-O-carboxymethyltartaric acid and pyridinedicarboxylic acid.

Typical anionic detergents which may be used are the alkylbenzenesulfonates having 10–15, e.g., 12, carbon atoms in the alkyl group particularly of the type described in U.S. Pat. No. 3,320,174, May 16, 1967 of J.

Rubinfeld; the olefin sulfonates having 12 to 20, e.g., 16, carbon atoms particularly mixtures of alkenesulfonates and hydroxyalkane-sulfonates obtained by reacting an alpha olefin with gaseous highly diluted $SO_3$ and hydrolyzing the resulting sultone-containing product, as by neutralizing with excess NaOH and heat treating to open the sultone ring; and the higher alkyl sulfates, such as tallow alcohol sulfate. Most commonly, these materials are employed as their sodium or other alkali metal salts, but ammonium or alkaline earth metal, e.g., magnesium salts, may be used. Mixtures of various anionic detergents, e.g., a mixture of a sodium alkylbenzene-sulfonate and a sodium olefin sulfonate may be employed.

Other anionic detergents are water-soluble soaps which may be used, alone or in combination with other detergents. Examples of soaps are the sodium, potassium, etc. salts of fatty acids such as lauric, myristic, stearic, oleic, elaidic, isostearic, palmitic, undecylenic, tridecylenic, pentadecylenic, 2-lower-alkyl higher-alkanoic (such as 2-methyl tridecanoic, 2-methyl pentadecanoic or 2-methyl heptadecanoic) or other saturated or unsaturated fatty acid of 11 to 20 carbon atoms. Soaps of dicarboxylic acids may also be used such as the soaps of dimerized linoleic acid. Soaps of such other higher molecular weight acids such as resin or tall oil acids, e.g., abietic acid, may also be employed. One specific suitable soap is the sodium soap of a mixture of tallow fatty acids and coconut oil fatty acids, e.g., in 3:1 ratio.

Suitable olefin sulfonate detergents and their preparation, are described in Rubinfeld et al U.S. Pat. Nos. 3,428,654 and 3,506,580 as well as in the references (dealing with olefin sulfonates) cited in those patents and in DiSalvo et al U.S. Pat. No. 3,420,875. Generally, the olefin sulfonates also contain small amounts, e.g., 1 to 15%, of disulfonates formed during the sulfonation reaction. The olefin sulfonates may be produced from alpha-olefins, internal olefins, or 2,2-di-alkylethylenes, having a vinylidene group, or from mixtures thereof as described in the aforementioned DiSalvo patent.

Another suitable anionic detergent is an alkyl phenol disulfonate such as one having an alkyl group having some 12 to 25 carbon atoms, preferably about 16 to 22 and more preferably about 18 to 20 carbon atoms. The alkyl group is preferably of the linear biodegradable type; one preferred typs is produced by alkylation of a phenol with an alpha olefin, such as a linear unbranched alpha olefin, and may have a primary or a secondary alkyl group, e.g., an alkyl group attached to the benzene ring at a point one, two, three or four carbon atoms from a terminal methyl group. In one typical material, about 10–15% of the alkyl groups are attached at the 2-position of the alkyl groups and the balance randomly at the 3, 4, 5, etc. positions and the alkyl group is for instance, in the ortho position with respect to the phenolic hydroxyl group; or the material may be a mixture of o-alkyl species with p-alkyl species. The alkyl phenol may be sulfonated in conventional manner in oleum, e.g., containing 15%, 20%, 25% or 50% $SO_3$, using sufficient oleum to, e.g., 1.2 to 1.5, such as 1.3 parts of 20% oleum per part of alkyl phenol, to produce a product containing in excess of 1.6, preferably above 1.8, e.g., 1.8 to 1.9 or 1.95, $SO_3H$ groups per alkyl phenol molecule. The disulfonate may be one whose phenolic hydroxyl group is blocked, as by etherification or esterification; thus the H of the phenolic OH may be replaced by an alkyl, e.g., ethyl, or hydroxyalkoxyalkyl, e.g., $-(CH_2CH_2O)_xH$ group in which x is one or more, such as 3, 6 or 10; and the resulting alcoholic OH may be esterified to form, say, a sulfate, e.g., $-SO_3Na$.

Other suitable anionic detergents are the paraffin sulfonates, such as the reaction products of alpha olefins and bisulfites, e.g., sodium bisulfite, for instance, the primary paraffin sulfonates of about 10–20, preferably about 15 to 20 carbon atoms.

Other suitable anionic detergents are sulfates of higher alcohols, such as sodium lauryl sulfate, sodium tallow alcohol sulfate, Turkey Red oil or other sulfated oils, or sulfates of mono- or diglycerides of fatty acids, e.g., stearic monoglyceride monosulfate, alkyl poly (ethenoxy) ether sulfates, such as the sulfates of the condensation products of ethylene oxide and lauryl alcohol, usually having 1 to 5 ethenoxy groups per molecule; lauryl or other higher alkyl glyceryl ether sulfonates; aromatic poly (ethenoxy) ether sulfates, such as the sulfates of the condensation products of ethylene oxide and nonyl phenol, usually having 1 to 20 oxyethylene groups per molecule, preferably 2–12.

The suitable anionic detergents include also the acyl sarcosinates, e.g., sodium lauroylsarcosinate, the acyl esters, e.g., oleic acid ester, of isothionates, and acyl N-methyl taurides, e.g., potassium N-methyl lauroyl- or oleyl tauride.

Suitable nonionic surface active agents include those surface active or detergent compounds which contain an organic hydrophobic group and a hydrophilic group which is a reaction product of a solubilizing group such as carboxylate, hydroxyl, amide or amine with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols (such as those having alkyl chains of 8 to 20, typically 10 to 18 carbon atoms) with ethylene oxide or mixtures of ethylene oxide and propylene oxide, and containing, say, 60 or 65% combined ethylene oxide, ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

Amphoteric detergents may also be included. Examples of these are n-alkyl-beta-aminopropionic acid; N-alkyl-beta-amino-dipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g., 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorous.

It is also within the broader scope of the invention to have cationic surface active agents (e.g. surface active detergent compounds which contain an organic hydrophobic group and a cationic solubilizing group) in the composition. Typical cationic solubilizing groups are amine and quaternary groups.

As examples of suitable synthetic cationic detergents there may be noted the diamines such as those of the type $RNHC_2H_4NH_2$ wherein R is an alkyl group of about 12 to 22 carbon atoms such as N-2-aminoethyl stearyl amine and N-2-aminoethyl myristyl amine; amido-linked amines such as those of the type $R^1CONHC_2H_4NH_2$ wherein $R^1$ is an alkyl group of about 9 to 20 carbon atoms, such as N-2-amino ethyl-stearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-di ethyl-stearyl ammonium chloride, trimethyl stearyl ammonium chloride, trimethyl-cetyl ammonium bromide, dimethyl-ethyl dilauryl ammonium chloride, dimethyl-propyl-myristyl ammonium chloride, and the corresponding methosulfates and acetates.

Compositions containing nonionic detergents, alone, or in admixture with anionic detergents constitute one particularly preferred class.

The most highly preferred water-soluble anionic detergent compounds are the ammonium, such as mono-, di- and triethanolamine, alkali metal, such as sodium and potassium, and alkaline earth metal such as calcium and magnesium, salts of the higher alkyl benzene sulfonates, olefin sulfonates, paraffin sulfonates, alkyl phenol disulfonates, the higher alkyl sulfates, and the higher fatty acid monoglyceride sulfates. The particular salt will be suitably selected depending upon the particular formulation and the proportions therein.

The composition preferably also contains a fluorescent brightener in small amount, as illustrated in the Examples. Such brighteners are well known; they may be cumarin types as illustrated in U.S. Pat. Nos. 2,590,485, 2,600,375, 2,610,152, 2,647,132, 2,647,133, 1,791,564, and 2,882,186; triazolyl stilbene types as illustrated in U.S. Pat. Nos. 2,668,777, 2,684,966, 2,714,057, 2,784,183, 2,784,197, 2,817,665, 2,907,760, 2,927,866 and 2,993,892; stilbene cyanuric types as illustrated in U.S. Pat. Nos. 2,473,475, 2,526,668, 2,595,030, 2,618,636, 2,658,064, 2,658,065, 2,660,578, 2,666,052, 2,694,064, and 2,840,557; acylamino stilbene types as illustrated in U.S. Pat. Nos. 2,084,413, 2,468,431, 2,521,665, 2,528,323, 2,581,057, 2,623,064, 2,674,604; and 2,676,982; or miscellaneous types such as shown in U.S. Pat. Nos. 2,911,415 and 3,031,460. The proportion of brightener may be for instance in the range of about 1/20% to 1%, e.g. 1/10% to ½%.

The tap water used in the foregoing Examples is Piscataway, New Jersey tap water having a hardness of about 100 ppm (expressed in conventional manner, as ppm of calcium carbonate) and a very small copper content (less than 1 ppm). A typical chemical analysis of the water supply is as follows, all figures (except pH) being in parts per million, unless otherwise indicated: total hardness 90, alkalinity 38, $CO_2$ 8, pH 7.6, chlorine 1.0, iron 0.05, manganese 0.00, consumed oxygen 0.6, dissolved oxygen 15.0, chlorides 25, total solids 165, organic and volatile 40, mineral matter 125, free ammonia 0.048, albumoid ammonia 0.015, nitrites as nitrogen 0.00, nitrates as nitrogen 0.20. A typical mineral analysis of this water supply (with figures again in ppm) is: sulfates 45, silica 15, calcium 23.2, magnesium 7.776.

Reference is here made to the patent application of Gray, Gangwisch, Wixon and Chirash, filed on the same date as the instant application and entitled Detergent Compositions, whose entire disclosure is incorporated herein by reference.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. Process for the production of hollow granules of detergent compositions containing sulfite which retains its content on storage under heated conditions which comprises forming an aqueous slurry containing an organic detergent and alkali metal sulfite, wherein, by weight based on the total non-volatile constituents of said slurry, the amount of detergent is from about 5% to about 40% and the amount of sulfite is from about 3% to about 70%, said slurry being at an elevated temperature of at least 90°F, agitating said slurry, spraying said slurry into a hot evaporative atmosphere of about 300°F to about 900°F to form air-containing hollow granules of the detergent composition containing at least 3% of sulfite.

2. Process as in claim 1 in which the sulfite is sodium sulfite.

3. Process as in claim 2 in which the spraying is through a nozzle which is positioned in a spray-drying zone and said evaporative atmosphere is air supplied to said zone.

4. Process as in claim 3 in which said slurry is agitated while at a temperature of at least about 120°F in air forming an air-containing slurry which is forced under a pressure in excess of 100 psig to nozzle.

5. Process as in claim 4 in which said evaporative atmosphere leaving said zone has a temperature above 180°F.

6. Process as in claim 1 in which said proportion of sulfite is within the range of about 5 to 40% and said organic detergent is largely an anionic sulfonate or sulfate detergent.

7. Process as in claim 6 in which said slurry contains about 5 to 35% sodium silicate, based on non-volatile content of the slurry.

8. Spray dried hollow granules of detergent composition produced by the process of claim 1.

9. Granules as in claim 8, said granules being vesiculated structures having generally rounded smooth surfaces, the bulk density of the mass of granules being in the range of about 0.3 to 0.6 g/cc.

10. Granules as in claim 9 containing about 3 to 70% sodium sulfite, about 10 to 50% alkaline builder salt including about 5 to 35% sodium silicate and about 5 to 40% organic detergent which is a sulfate or sulfonate salt or mixture thereof.

11. Granules as in claim 10 containing nonionic detergent.

12. Granules as in claim 9 containing a detergent builder salt, which is a sodium salt of a water-soluble phosphate, phosphonate, carboxylic acid salt, silicate, or carbonate or mixture thereof.

* * * * *